US012304673B2

(12) United States Patent
Zheng

(10) Patent No.: US 12,304,673 B2
(45) Date of Patent: May 20, 2025

(54) FILM WRAPPING MACHINE AND FILM LEADING DEVICE THEREFOR

(71) Applicant: TAIWAN HIGHDREAM INTELLECTUALIZED MACHINERY CO., LTD., Taichung (TW)

(72) Inventor: Ying Zheng, Taichung (TW)

(73) Assignee: TAIWAN HIGHDREAM INTELLECTUALIZED MACHINERY CO., LTD., Taichung (TW)

( * ) Notice: Subject to any disclaimer, the term of this patent is extended or adjusted under 35 U.S.C. 154(b) by 28 days.

(21) Appl. No.: 18/404,948

(22) Filed: Jan. 5, 2024

(65) Prior Publication Data

US 2024/0343430 A1 Oct. 17, 2024

(30) Foreign Application Priority Data

Apr. 17, 2023 (CN) ..... 202320842953.7

(51) Int. Cl.
*B65B 11/02* (2006.01)

(52) U.S. Cl.
CPC ..... *B65B 11/025* (2013.01)

(58) Field of Classification Search
None
See application file for complete search history.

(56) References Cited

U.S. PATENT DOCUMENTS 3,101,913 A * 8/1963 Davis ..... B65B 41/16 226/193

FOREIGN PATENT DOCUMENTS

CN 105416642 A * 3/2016 ..... B65B 11/10
CN 113212826 A * 8/2021 ..... B65B 11/025

* cited by examiner

*Primary Examiner* — Tanzim Imam
(74) *Attorney, Agent, or Firm* — WPAT, PC

(57) ABSTRACT

A film wrapping machine has a film leading device having a fixed frame, a shaft, a film-leading component, a torsion spring, a positioning block, and a positioning pin. The shaft is rotatably disposed on the fixed frame; the film-leading component is fixed on the shaft and has a frame body, a film-holding board disposed on the frame body, and a limiting element. The positioning block has a pin groove, and the positioning block and the positioning pin are respectively disposed on the fixed frame and the frame body. When unlocking, the positioning pin is detached from the pin groove, and the torsion spring actuates the film-leading component and the shaft to rotate relative to the fixed frame. When repositioning, the film-leading component is pushed to allow the positioning pin to be reinserted into the pin groove.

14 Claims, 10 Drawing Sheets

FILM WRAPPING MACHINE AND FILM LEADING DEVICE THEREFOR

BACKGROUND

1. Field of the Invention

The present invention relates to a wrapping machine, and particularly to a film wrapping machine and a film leading device therefor.

2. Description of Related Art

In a film wrapping machine, after a wrapping film roll is disposed, a starting end of the wrapping film is led into a film gripping device by a film leading device to ensure that the film gripping device grips and transports the wrapping film for wrapping. A conventional film leading device has a joystick and a film leading mechanism, and the joystick is connected to the film leading mechanism and protrudes from a side of a machine frame of the film wrapping machine. By pulling the joystick to a positioning mechanism on the side of the machine frame, the film leading mechanism can be positioned and lead the wrapping film into the film gripping device.

However, when changing the wrapping film roll or repairing the device for fixing the wrapping film roll, since the conventional film leading device is positioned by the joystick that protrudes from the side of the machine frame, an operator needs to unlock the positioning of the film leading mechanism by operating the joystick at the side of the fixed machine frame first, move to a rear of the fixed machine frame to stretch the wrapping film roll, and then move back to the side of the machine frame to reposition the film leading mechanism; the above operation is time-consuming and therefore exchanging and repairing of the film wrapping machine take too much time; further, the conventional film leading device has complicated configurations and occupies larger space.

SUMMARY

To overcome the shortcomings of the conventional film leading device being time-consuming in operation, the present invention tends to provide a film wrapping machine and a film leading device therefor which are simple, convenient, and time-saving in operation.

The film leading device for a film wrapping machine provided by the present invention is characterized in that the film leading device comprises a fixed frame, a shaft, a film-leading component, at least one torsion spring, at least one positioning block, and at least one positioning pin. The shaft is rotatably disposed on the fixed frame, and the film-leading component is fixed on the shaft and has a frame body, a film-holding board, and a limiting element. The frame body has a first side and a second side being opposite to each other and a film-passing opening defined through the frame body. The film-holding board extends from an edge of the film-passing opening and protrudes from the first side of the frame body. The limiting element is disposed on the frame body, protrudes from the first side of the frame body, and is configured to abut against a limiting board of the film wrapping machine. The at least one torsion spring is disposed on the shaft and has two opposite ends respectively positioned on the fixed frame and the frame body of the film-leading component. Said positioning block has a pin groove, and said positioning pin is configured to be detachably inserted into the pin groove. Said positioning block and said positioning pin are respectively disposed on the fixed frame and the frame body. When said positioning pin is detached from the pin groove, said torsion spring actuates the film-leading component and the shaft to rotate relative to the fixed frame.

For the film leading device as described above, the film leading device has two said positioning pins and two said positioning blocks; the two positioning pins are respectively disposed on two opposite ends of the frame body; each one of the two positioning pins is configured to be detachably inserted into the pin groove of a respective one of the two positioning blocks.

For the film leading device as described above, the film leading device has two said torsion springs respectively disposed on two opposite ends of the shaft.

For the film leading device as described above, said positioning block has a leading inclined surface extending from a side of said positioning block toward the pin groove; said positioning pin is configured to abut against the leading inclined surface, move along the leading inclined surface, and then be inserted into the pin groove.

For the film leading device as described above, the film-leading component has at least one film roller mounted on the second side of the frame body.

For the film leading device as described above, the film-leading component has multiple said film rollers arranged in parallel along a direction from a top of the frame body toward a bottom of the frame body.

For the film leading device as described above, the film-holding board has multiple protruding teeth arranged at spaced intervals; the multiple protruding teeth are located at an end of the film-holding board away from the frame body.

The film wrapping machine provided by the present invention is characterized in that the film wrapping machine comprises the film leading device as described above.

By means of the aforementioned technical features, the present invention provides efficacy as follows:

1. The film leading device for a film wrapping machine of the present invention applies said positioning pin, said positioning block with the pin groove, and said torsion spring, which allows the operator to unlock the positioning of the film-leading component and reposition the film-leading component at the rear of the machine frame of the film wrapping machine. Compared to the conventional film leading device of the film wrapping machine with the film leading mechanism being positioned at the side of the machine frame, the film leading device of the present invention has simpler operation method and significantly reduces operation time.
2. Compared to the conventional film leading device having the joystick and other corresponding constructions to position the film leading mechanism, the present invention has simpler configuration, occupies less space, and has lower manufacturing cost.

DETAILED DESCRIPTION OF THE PREFERRED EMBODIMENT

Figure 1:
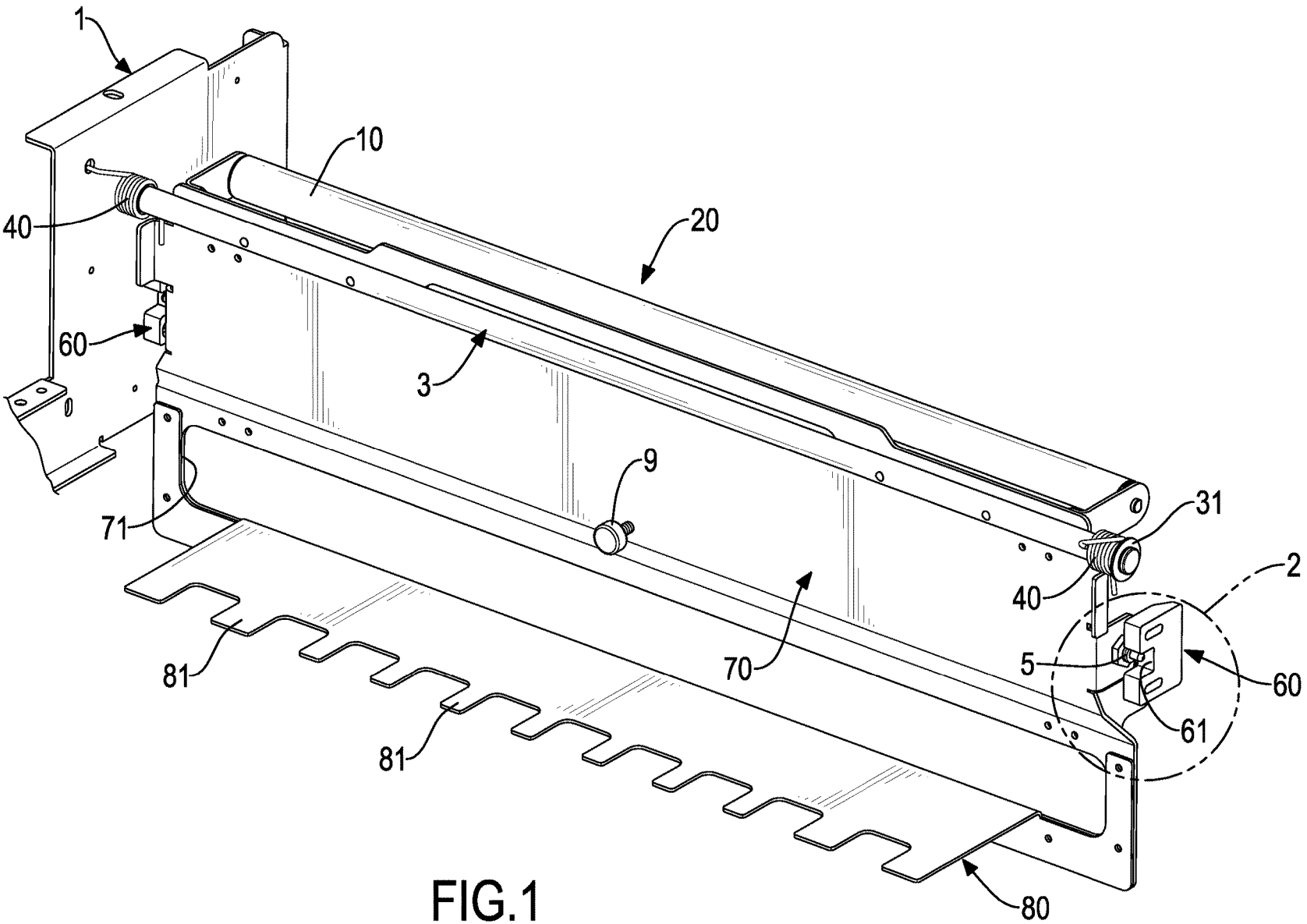
FIG. 1 is a perspective view of a film leading device for a film wrapping machine of a preferred embodiment in accordance with the present invention omitting a part of a fixed frame.
Figure 3:
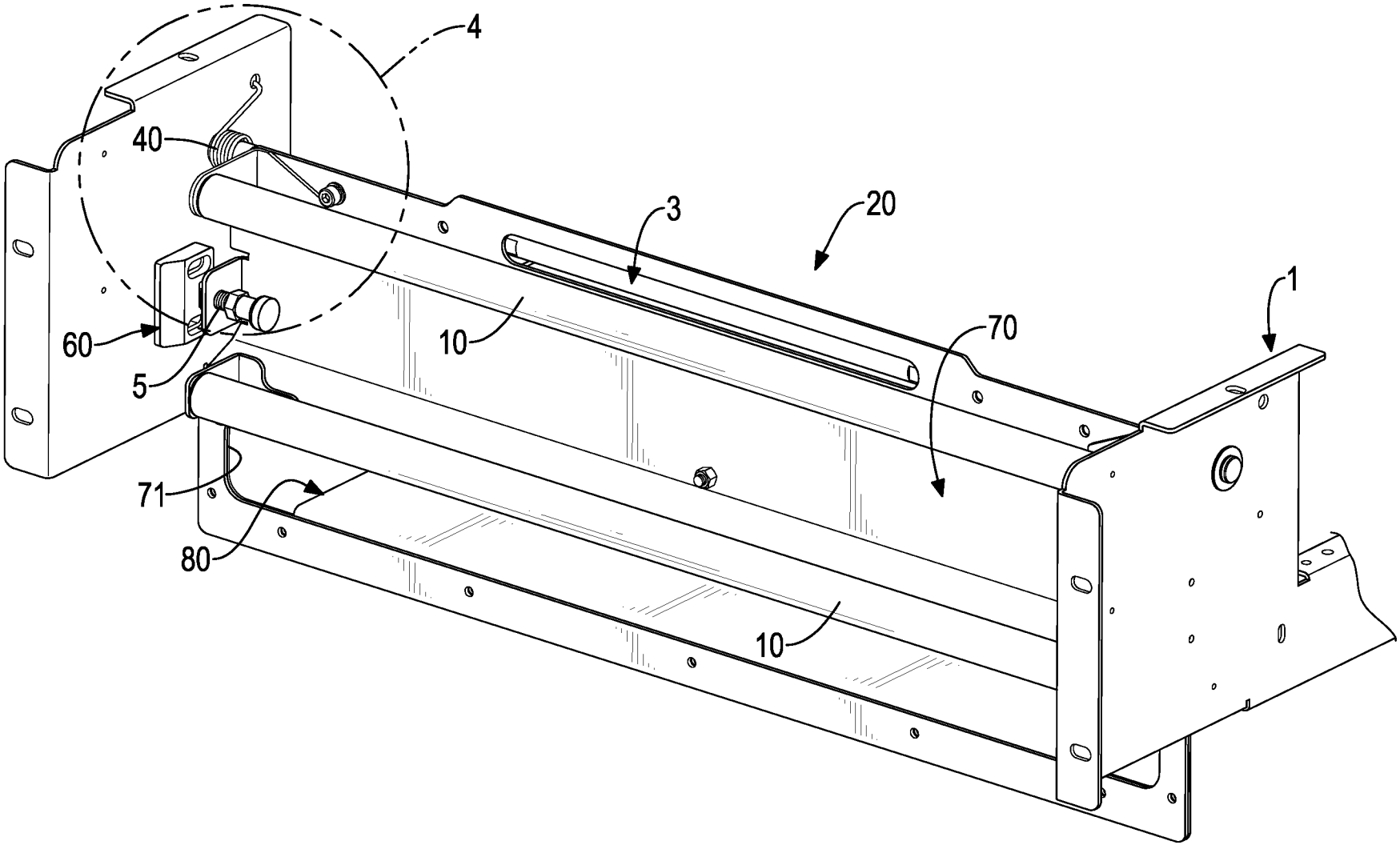
FIG. 3 is another perspective view of the film leading device in FIG. 1.
Figure 5:
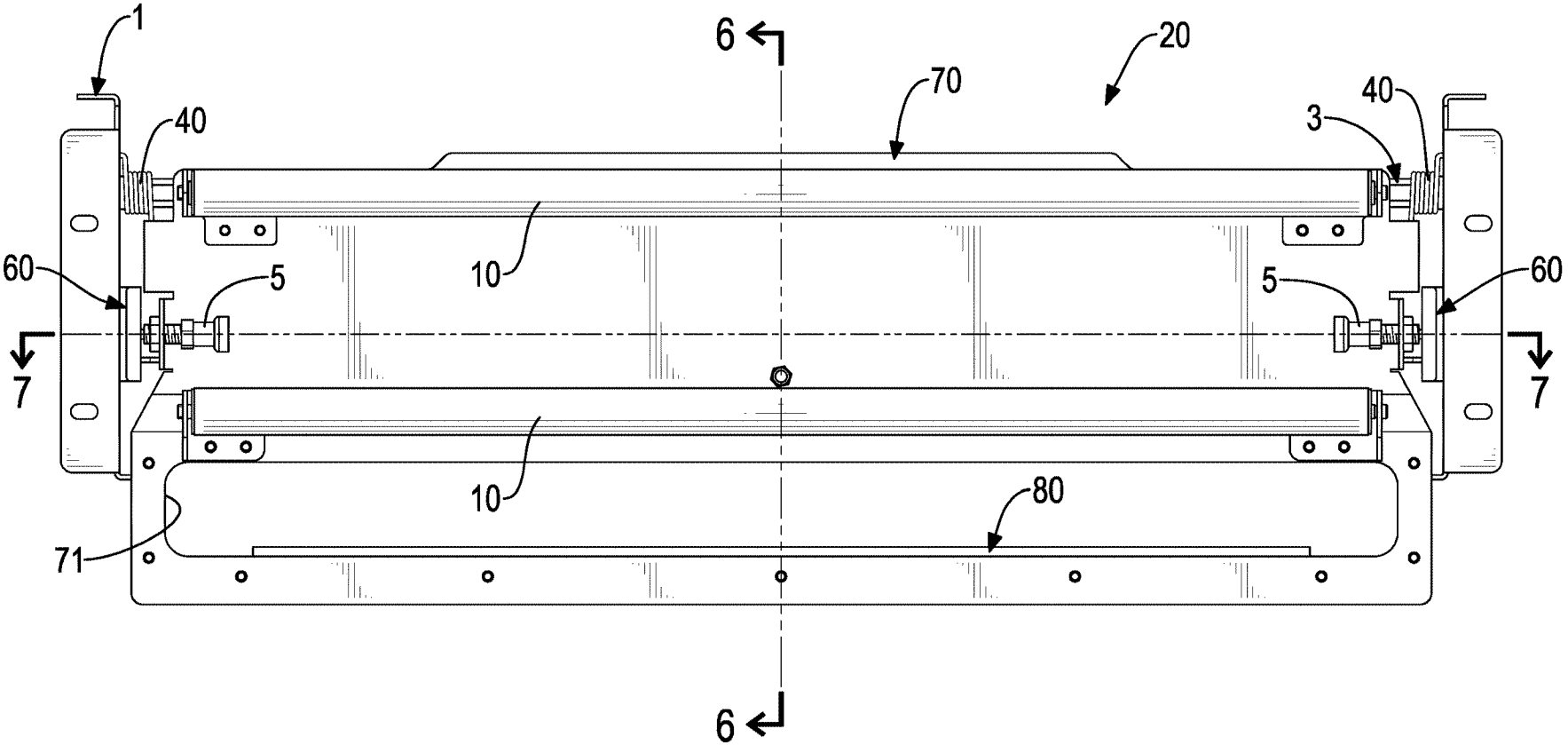
FIG. 5 is a side view of the film leading device in FIG. 1.
Figure 6:
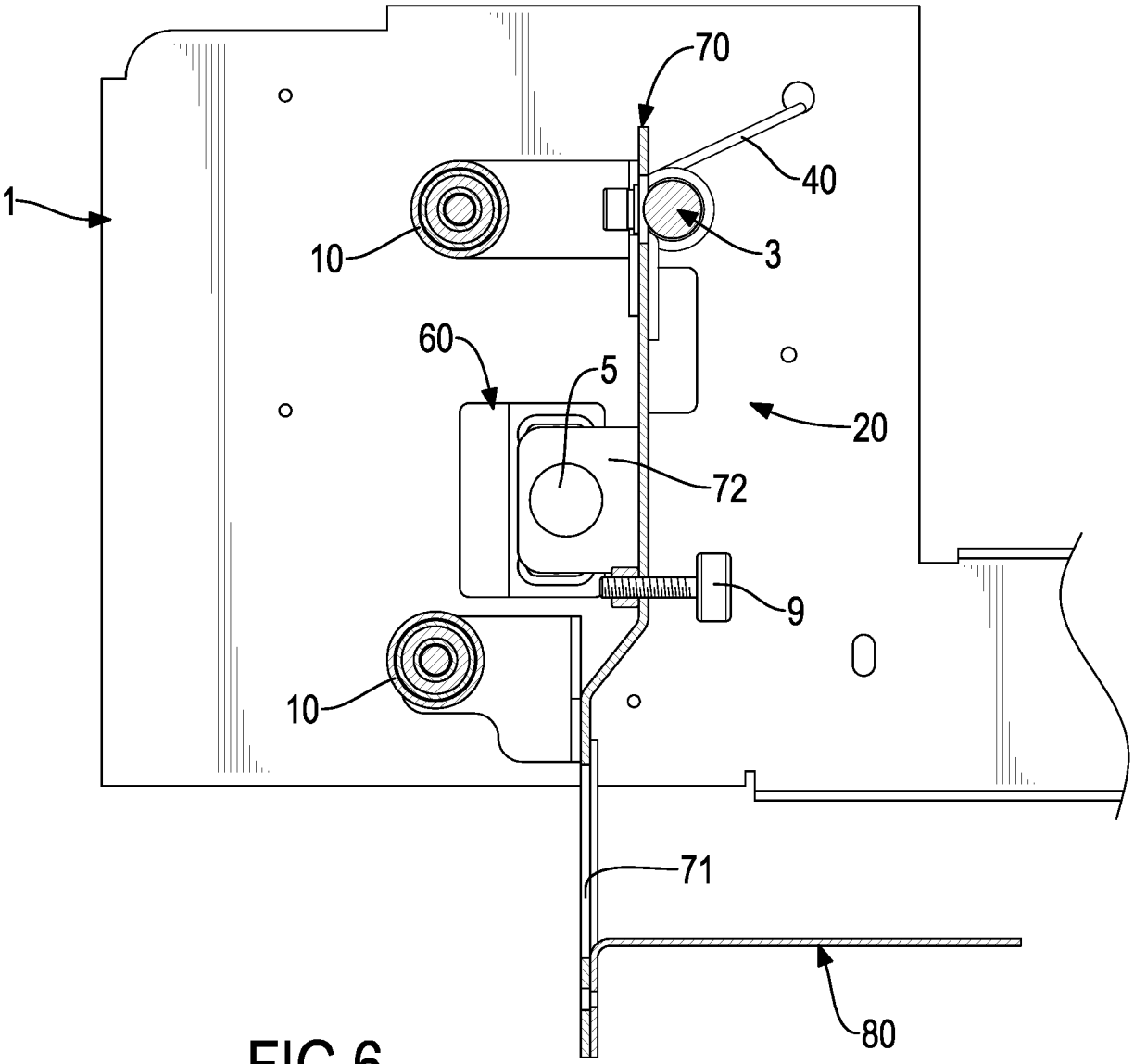
FIG. 6 is a sectional side view of the film leading device across line 6-6 in FIG. 5.
Figure 7:
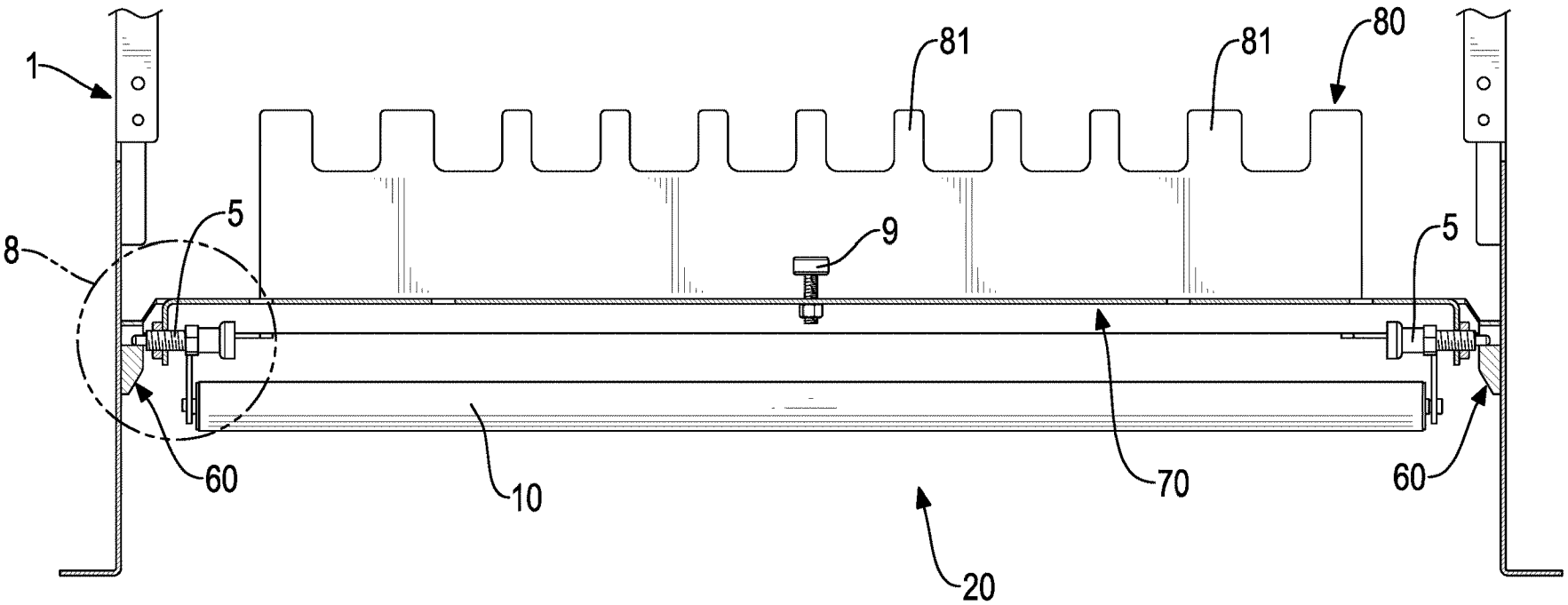
FIG. 7 is a sectional side view of the film leading device across line 7-7 in FIG. 5.

With reference to FIGS. 1, 3, and 5, a film leading device for a film wrapping machine of a preferred embodiment in accordance with the present invention has a fixed frame 1, a film-leading component 20, a shaft 3, two torsion springs 40, two positioning pins 5, and two positioning blocks 60. The shaft 3 is rotatably disposed on the fixed frame 1, and the film-leading component 20 is fixed on the shaft 3. The film-leading component 20 has a frame body 70, a film-holding board 80, and a limiting element 9. With reference to FIGS. 1, 6, and 7, the frame body 70 has a first side and a second side being opposite to each other and a film-passing opening 71 defined through the frame body 70. The film-holding board 80 is connected to a bottom of the frame body 70, extends from an edge of the film-passing opening 71, protrudes from the first side of the frame body 70, and has multiple protruding teeth 81 located at an end of the film-holding board 80 away from the frame body 70. The limiting element 9 is disposed on the first side of the frame body 70 and protrudes from the first side of the frame body 70.

Figure 4:
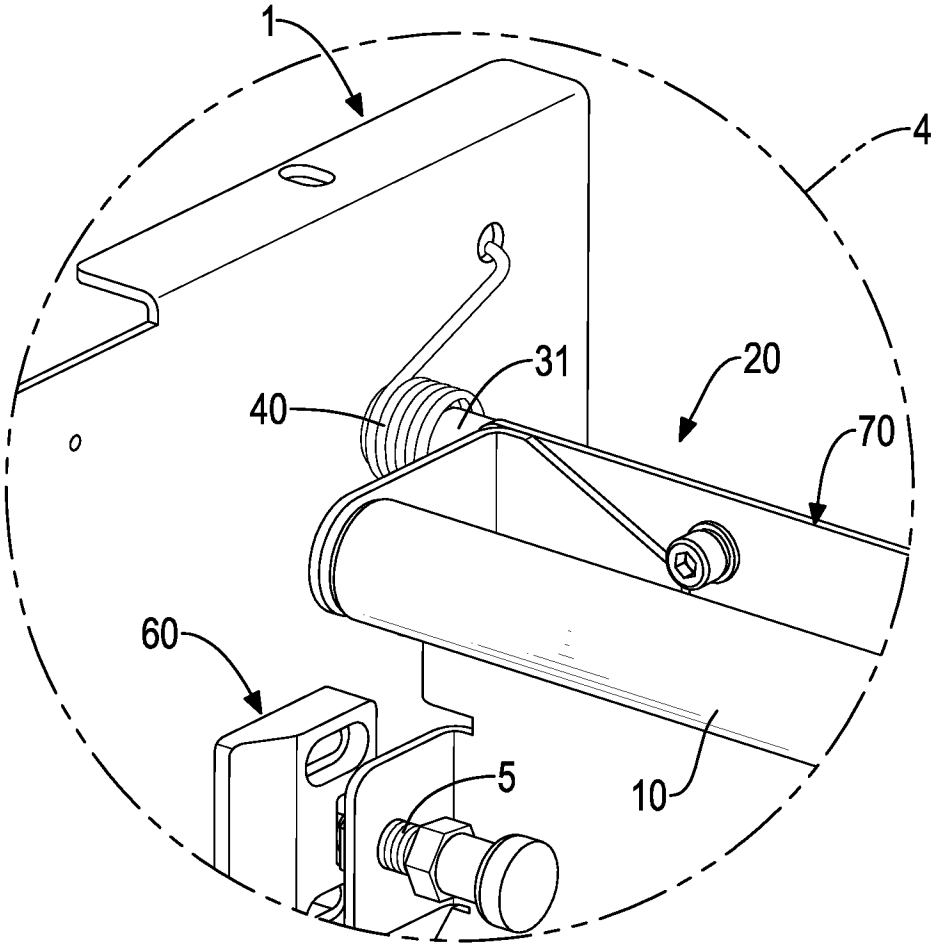
FIG. 4 is an enlarged view of the circled area 4 of FIG. 3.

With reference to FIGS. 4 to 6, the two torsion springs 40 are respectively disposed on two opposite ends of the shaft 3. Specifically, the fixed frame 1 has two side boards being parallel to each other, and each one of the two opposite ends of the shaft 3 is mounted onto a respective one of the two side boards of the fixed frame 1 via a flange bearing 31. Each one of the two torsion springs 40 is sheathed onto said flange bearing 31 and has two opposite ends respectively positioned on the fixed frame 1 and the frame body 70 of the film-leading component 20.

Figure 2:
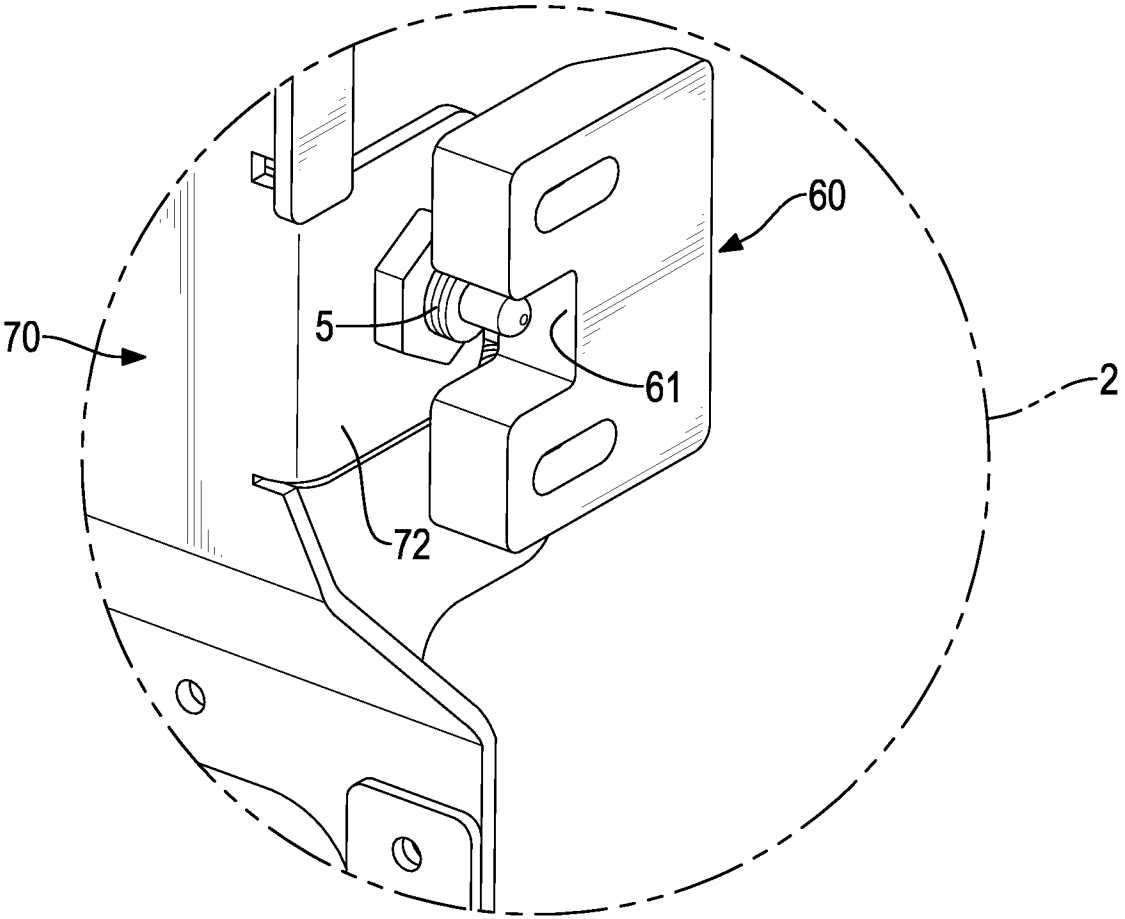
FIG. 2 is an enlarged view of the circled area 2 of FIG. 1.
Figure 8:
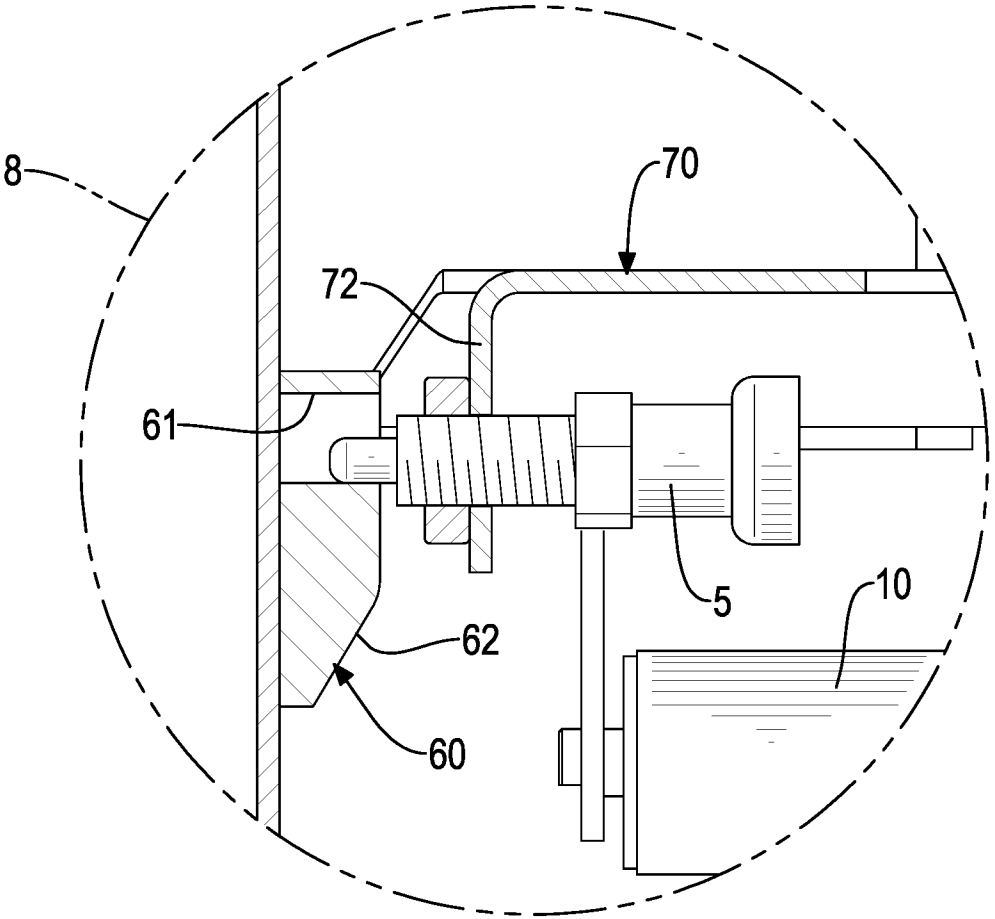
FIG. 8 is an enlarged view of the circled area 8 of FIG. 7.

With reference to FIG. 5, the two positioning pins 5 are respectively disposed on two opposite ends of the frame body 70, and the two positioning blocks 60 are fixed on the fixed frame 1. Specifically, with reference to FIGS. 2, 6, and 8, the frame body 70 has two mounting tabs 72 protruding from the two opposite ends of the frame body 70, and each one of the two positioning pins 5 is fixed on a respective one of the two mounting tabs 72. In the preferred embodiment, each one of the two positioning pins 5 is an index pin and has a pin body and a restoring spring disposed therein, and the pin body is configured to bear an external force to move and compress the restoring spring and is configured to be driven by a restoring force of the restoring spring to move back to the original position when the external force disappears. With reference to FIGS. 2 and 8, each one of the two positioning blocks 60 has a pin groove 61, and each one of the two positioning pins 5 is configured to be inserted into or detached from the pin groove 61 of a respective one of the two positioning blocks 60.

Figure 9:
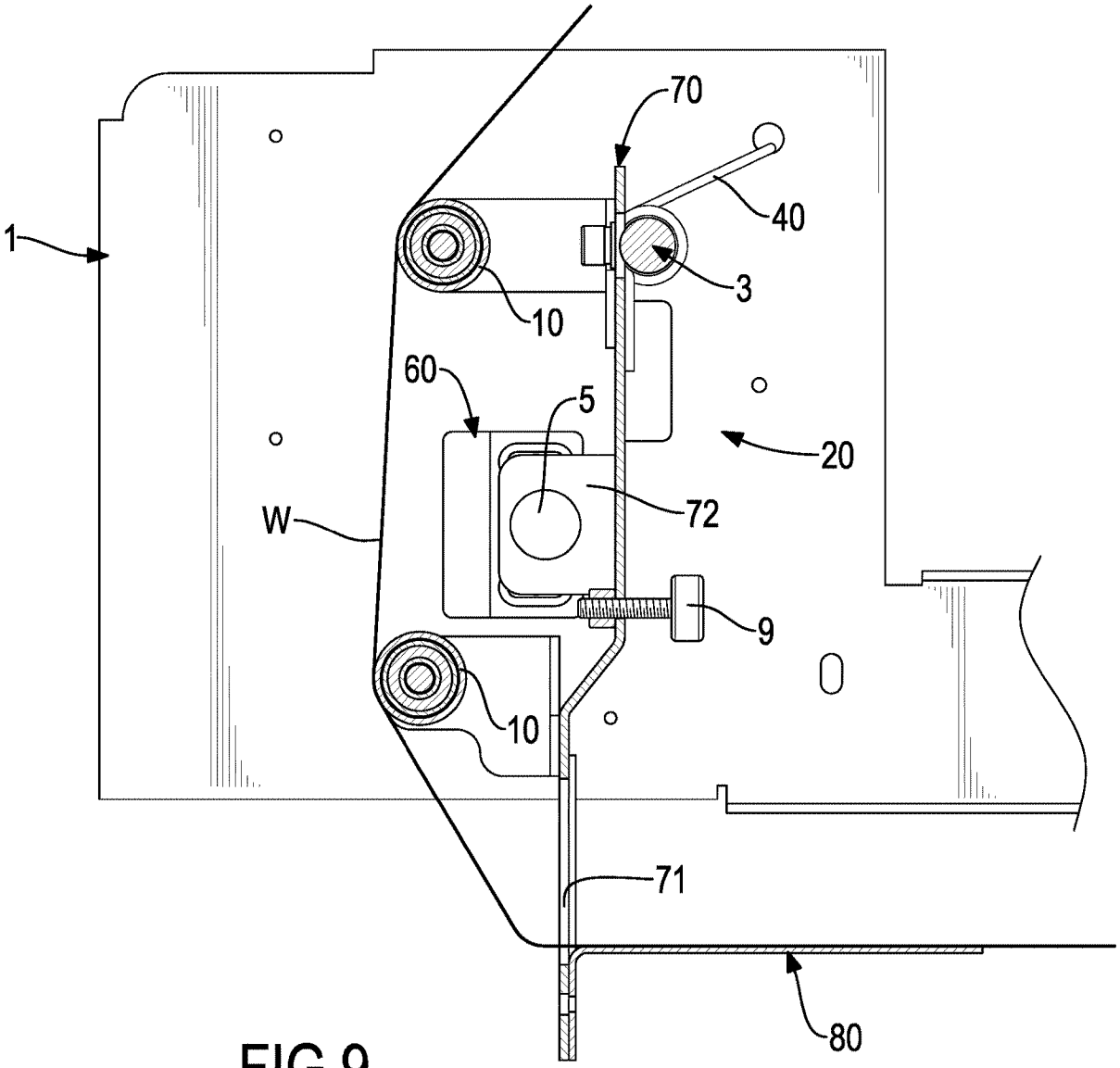
FIG. 9 is an operational view of the film leading device in FIG. 1.

The film leading device is applied to be mounted in a film wrapping machine, and operation of the film leading device is described below. After exchanging a wrapping film roll of the film wrapping machine, a starting end of the wrapping film roll needs to be led into a film gripping device of the film wrapping machine. With reference to FIG. 9, the preferred embodiment takes a plastic wrap roll with plastic wrap W as an example for description. An operator can detach each one of the two positioning pins 5 from the pin groove 61 of the corresponding positioning block 60 at a rear of a machine frame of the film wrapping machine, and the restoring force of said torsion spring actuates the film-leading component 20 and the shaft 3. Afterwards, the operator stretches the plastic wrap W, mounts the plastic wrap W through the film-passing opening 71, lays the plastic wrap W on the film-holding board 80, and then stretches the plastic wrap W over the end of the film-holding board 80 away from the frame body 70.

Figure 10:
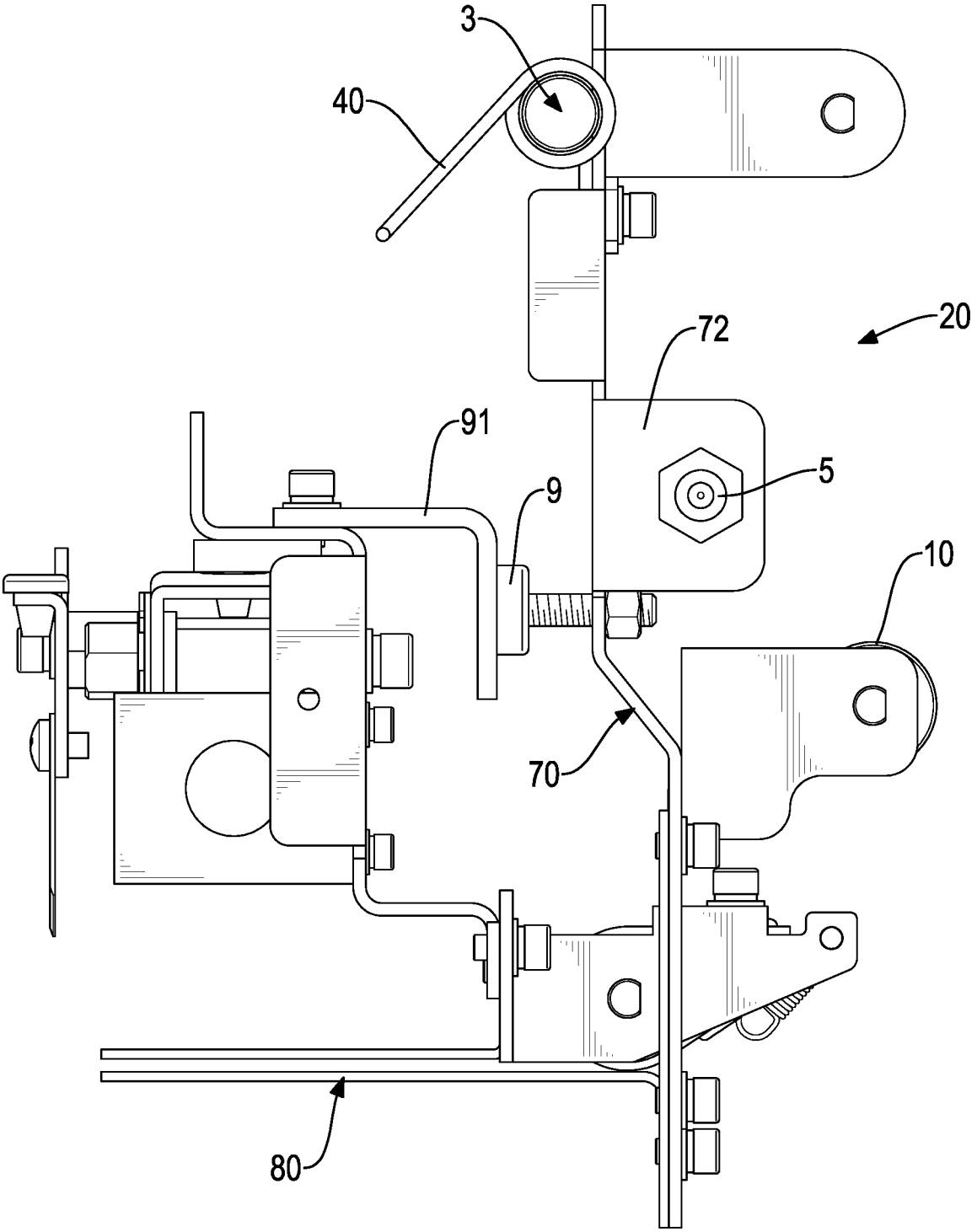
FIG. 10 is a side view of a limiting element of the film leading device in FIG. 1 abutting against a limiting board of the film wrapping machine.

Then, the operator can push the film-leading component 20 to overcome the restoring force of said torsion springs 40 so that the film-leading component 20 and the shaft 3 rotate relative to the fixed frame 1 to allow each one of the two positioning pins 5 to be reinserted into the pin groove 61 of the corresponding positioning block 60 for repositioning the film-leading component 20. When repositioning, the film-holding board 80 leads the starting end of the plastic wrap W into the film gripping device so that the film wrapping machine can undergo packing by the film gripping device gripping and transporting the plastic wrap W. When repositioning the film-leading component 20, with reference to FIG. 10, the limiting element 9 of the film-leading component 20 abuts against a limiting board 91 of the film wrapping machine after each one of the two positioning pins 5 is reinserted into the pin groove 61 of the corresponding positioning block 60, which reminds the operator to stop pushing the film-leading component 20. The above configuration prevents the film-leading component 20 from being overpushed and being damaged due to overpushing and prevents operation of film leading being interrupted.

The film leading device for a film wrapping machine of the present invention applies simple configuration of said positioning pin 5, said positioning blocks 60 with the pin groove 61, and said torsion springs 40, which allows the operator to unlock the positioning of the film-leading component 20 and reposition the film-leading component 20 at the rear of the machine frame of the film wrapping machine. Compared to the conventional film leading device of the film wrapping machine with the film leading mechanism being positioned at the side of the machine frame, the film leading device of the present invention has simpler operation method and reduces operation time. Compared to the conventional film leading device having the joystick and other corresponding constructions and thus occupying more space, the present invention has simpler configuration, occupies less space, and has lower manufacturing cost.

In the preferred embodiment, the two positioning pins 5 are respectively disposed on two opposite ends of the frame body 70, and the two positioning blocks 60 are fixed on the fixed frame 1. In other embodiments, the positioning blocks 60 may be respectively disposed on two opposite ends of the frame body 70 with the two positioning pins 5 fixed on the fixed frame 1; the film leading device can still position the film-leading component 20 and unlock the positioning of the film-leading component 20. The positions of said positioning pins 5 and said positioning blocks 60 are not limited to the preferred embodiment.

In the preferred embodiment, the film leading device has two positioning blocks 60 and the two positioning pins 5 respectively matching the two positioning blocks 60. In other embodiments, as long as the film leading device has at least one said positioning block 60 and at least one said positioning pin 5 configured to be inserted into or detached from the pin groove 61 of the at least one said positioning block 60, the film leading device is able to position the film-leading component 20 and unlock the positioning of the film-leading component 20. Thereby, numbers of said positioning blocks 60 and said positioning pins 5 are not limited to the preferred embodiment. In the preferred embodiment, by the two positioning pins 5 respectively disposed on the two opposite ends of the frame body 70, forces acted on the frame body 70 when positioning the film-leading component 20 can be evenly distributed, which reduces deformation of the frame body 70.

With reference to FIG. 2, in the preferred embodiment, each one of the two positioning blocks 60 has two elongated mounting holes; by mounting a bolt through said mounting hole to fix said positioning block 60 on the fixed frame 1, the position of said positioning block 60 being disposed on the fixed frame 1 can be adjusted to allow said positioning pin 5 to be precisely inserted into the pin groove 61 of said positioning block 60, which improves accuracy of operation of the film leading device.

In the preferred embodiment, the film leading device has two torsion springs 40; in other embodiments, as long as the film leading device has at least one said torsion spring 40 disposed on the shaft 3 with one of the two opposite ends of said torsion spring 40 being fixed on the fixed frame 1 and the other one of the two opposite ends of said torsion spring 40 abutting against the frame body 70, the at least one said torsion spring 40 can actuate the film-leading component 20 to rotate when the positioning of the film-leading component 20 is unlocked. In the preferred embodiment, by the two torsion springs 40 respectively disposed on the two opposite ends of the shaft 3, forces actuating the film-leading component 20 to rotate when unlocking the positioning of the film-leading component 20 can be evenly distributed, which ensures the film-leading component 20 smoothly rotates for the operator to lead the plastic wrap thereinto.

With reference to FIG. 8, in the preferred embodiment, each one of the two positioning blocks 60 has a leading inclined surface 62 extending from a side of said positioning block 60 toward the pin groove 61. When the operator pushes the film-leading component 20 to reposition the film-leading component 20, said positioning pin 5 abuts against the leading inclined surface 62 of the corresponding positioning block 60, moves along the leading inclined surface 62, and is then smoothly inserted into the pin groove 61 of the corresponding positioning block 60, which improves convenience of operation of the film-leading component 20.

With reference to FIGS. 3, 6, and 9, in the preferred embodiment, the film-leading component 20 further has two film rollers 10 mounted on the second side of the frame body. The two film rollers 10 are arranged in parallel along a direction from a top of the frame body 70 toward the bottom of the frame body 70. With reference to FIG. 9, after the starting end of the plastic wrap W is pulled by the two film rollers 10, is mounted through the film-passing opening 71, and is laid on the film-holding board 80, the plastic wrap W is attached to the two film rollers 10 and is tensioned by the two film rollers 10; thereby the two film rollers 10 can lead the plastic wrap W to a specific direction and prevent the plastic wrap W from loosening. In addition, in the preferred embodiment, the film-leading component 20 has the two film rollers 10, but in other embodiments, the number of said film rollers 10 can be decided according to the size of the frame body and is not limited to the preferred embodiment.

The present invention further provides a film wrapping machine having the film leading device of the preferred embodiment so that the overall operating time of the film wrapping machine is reduced, and the film wrapping machine occupies less space and has lower manufacturing cost.

Through the foregoing paragraphs, the preferred embodiments and detailed descriptions thereof are described for presenting the technical means adopted by the present invention to solve the problem, not to constrain the scope of the claimed invention. Anything that is literally consistent with the claims of the present invention and variations and modifications that are equivalent to the claims are encompassed by the scope of the claims of the present invention.

What is claimed is:

1. A film leading device for a film wrapping machine, the film leading device comprising:
- a fixed frame;
- a shaft rotatably disposed on the fixed frame;
- a film-leading component fixed on the shaft and having:
  - a frame body having:
    - a first side and a second side that are opposite to each other; and
    - a film-passing opening defined through the frame body;
  - a film-holding board extending from an edge of the film-passing opening and protruding from the first side of the frame body; and
  - a limiting element disposed on the frame body, protruding from the first side of the frame body, and configured to abut against a limiting board of the film wrapping machine;
- at least one torsion spring disposed on the shaft and having
  - two opposite ends respectively positioned on the fixed frame and the frame body of the film-leading component;
- at least one positioning block having a pin groove; and
- at least one positioning pin configured to be detachably inserted into the pin groove;
- wherein the at least one positioning block and the at least one positioning pin are respectively disposed on the fixed frame and the frame body of the film-leading component; and wherein when the at least one positioning pin is detached from the pin groove, the at least one torsion spring actuates the film-leading component and the shaft to rotate relative to the fixed frame.

2. The film leading device for a film wrapping machine as claimed in claim 1, wherein:
- the at least one positioning pin comprises two positioning pins and the at least one positioning block comprises two positioning blocks;
- the two positioning pins are respectively disposed on two opposite ends of the frame body; and
- each one of the two positioning pins is configured to be detachably inserted into the pin groove of a respective one of the two positioning blocks.

3. The film leading device for a film wrapping machine as claimed in claim 1, wherein the at least one torsion spring comprises two torsion springs respectively disposed on two opposite ends of the shaft.

4. The film leading device for a film wrapping machine as claimed in claim 1, wherein:
- the at least one positioning block has a leading inclined surface extending from a side of said at least one positioning block toward the pin groove; and the at least one positioning pin is configured to abut against the leading inclined surface, move along the leading inclined surface, and then be inserted into the pin groove.

5. The film leading device for a film wrapping machine as claimed in claim 1, wherein the film-leading component has at least one film roller mounted on the second side of the frame body.

6. The film leading device for a film wrapping machine as claimed in claim 5, wherein at least one film roller comprises multiple film rollers arranged in parallel along a direction from a top of the frame body toward a bottom of the frame body.

7. The film leading device for a film wrapping machine as claimed in claim 1, wherein:

the film-holding board has multiple protruding teeth arranged at spaced intervals; and the multiple protruding teeth are located at an end of the film-holding board away from the frame body.

8. A film wrapping machine comprising the film leading device for a film wrapping machine as claimed in claim 1.

9. The film wrapping machine as claimed in claim 8, wherein:

the at least one positioning pin comprises two positioning pins and the at least one positioning block comprises two positioning blocks;

the two positioning pins are respectively disposed on two opposite ends of the frame body; and each one of the two positioning pins is configured to be detachably inserted into the pin groove of a respective one of the two positioning blocks.

10. The wrapping machine as claimed in claim 8, wherein the film the at least one torsion spring comprises two torsion springs respectively disposed on two opposite ends of the shaft.

11. The film wrapping machine as claimed in claim 8, wherein:

said at least one positioning block has a leading inclined surface extending from a side of said at least one positioning block toward the pin groove; and said at least one pin is configured to abut against the leading inclined surface, move along the leading inclined surface, and then be inserted into the pin groove.

12. The film wrapping machine as claimed in claim 8, wherein the film-leading component has at least one film roller mounted on the second side of the frame body.

13. The film wrapping machine as claimed in claim 12, wherein the at least one film roller comprises multiple film rollers arranged in parallel along a direction from a top of the frame body toward a bottom of the frame body.

14. The film wrapping machine as claimed in claim 8, wherein:

the film-holding board has multiple protruding teeth arranged at spaced intervals; and the multiple protruding teeth are located at an end of the film-holding board away from the frame body.

* * * * *